United States Patent [19]

Arndt

[11] Patent Number: 4,557,841

[45] Date of Patent: Dec. 10, 1985

[54] LUBRICANT ADDITIVE CONCENTRATE

[75] Inventor: George Arndt, Newbury Park, Calif.

[73] Assignee: Wynn Oil Company, Fullerton, Calif.

[21] Appl. No.: 671,116

[22] Filed: Nov. 13, 1984

[51] Int. Cl.[4] ..... C10M 1/48

[52] U.S. Cl. ..... 252/32.7 E; 252/33.4; 252/45; 252/56 R

[58] Field of Search ..... 252/32.7 E, 45, 33.4, 252/56 R

[56] References Cited

U.S. PATENT DOCUMENTS

| | | | |
|---|---|---|---|
| 3,640,860 | 2/1972 | Miller | 252/56 R |
| 3,849,323 | 11/1974 | Hollinshead | 252/56 R |
| 4,067,817 | 1/1978 | Sturwold | 252/56 R |
| 4,075,393 | 2/1978 | Sturwold | 252/49.5 |
| 4,108,785 | 8/1978 | Sturwold | 252/56 R |
| 4,130,495 | 12/1978 | Wisneak et al. | 252/48.6 |
| 4,329,298 | 5/1982 | Brown | 106/270 |

*Primary Examiner*—Jacqueline V. Howard
*Attorney, Agent, or Firm*—William W. Haefliger

[57] ABSTRACT

A crankcase motor oil additive concentrate comprising a detergent-inhibitor package, supplemental antiwear additives, a corrosion inhibitor, and jojoba oil in a petroleum base stock.

8 Claims, No Drawings

LUBRICANT ADDITIVE CONCENTRATE

BACKGROUND OF THE INVENTION

This invention relates to lubricants used in automobile engines and similar equipment. More particularly, it relates to a novel additive concentrate designed to be added to an ordinary crankcase motor oil to improve its ability to lubricate and protect the engine.

As the internal combustion engines used in automobiles have increased in sophistication and power, the demands made on the crankcase motor oil used in these engines have increased proportionately. Modern gasoline engine oils must meet American Petroleum Institute (API) service rating "SF", a designation which requires the oil to pass a stringent sequence of engine tests to measure its ability to lubricate the engine and reduce corrosion, varnish, and sludge deposits, An "SF" oil will contain a highly refined petroleum or synthetic lubricant base oil which is fortified by antiwear and lubricity additives, detergents and dispersants, rust and corrosion inhibitors, antioxidants, antifoam, seal conditioners, pour point depressants and the like. Whereas new oil will contain sufficient additives to meet engine requirements, many of these additives such as the antiwear agents, detergent/dispersants and corrosion inhibitors, are gradually depleted when the oil is in service. The problem is accentuated by the longer oil change intervals that are now common. At one time, motor oils were routinely changed after two or three thousand miles of driving. Today, a drain interval of 7500 miles is a common recommendation of automobile manufacturers, and many drivers tend to put off oil changes even further, with the result that the oil may become seriously depleted of necessary additives, and its ability to protect the engine may be seriously compromised.

A partial solution to this problem is the use of oil additive concentrates, which supplement and enhance the effectiveness of the additive system already present in the used oil. Such oil additive concentrates, added to the crankcase at a treatment level of about 5 to 15% of the regular oil, may replace depleted additives in the original oil and/or introduce new ones. Just as it has been constantly necessary to upgrade crankcase motor oil formulations to satisfy the increasing demands of modern engines, there is a constant need for improved oil additive concentrates to supplement the ability of these oils to protect engines in view of the rigorous demands made on them by modern motorists. It is an object of may invention to provide a novel and improved oil additive concentrate to satisfy this need.

SUMMARY OF THE INVENTION

The oil additive concentrate of my invention comprises the following:

(1) a petroleum base stock of quality and viscosity suitable for the blending of crankcase motor oils;

(2) a detergent-inhibitor package capable of forming a finished crankcase motor oil of API SF quality when added at the appropriate level to a suitable base stock such as (1);

(3) a supplemental antiwear additive selected from the salts of dialkyl dithiophosphoric acid, the zinc salt being preferred;

(4) a supplemental antiwear additive selected from the class of sulfurized olefins;

(5) a corrosion-inhibitor selected from the class of overbased sulfonates, the sodium salts being preferred; and (6) a lubricity additive, the oil extracted from the seed of *Simmondsia chinensis,* known familarly as jojoba oil.

The closest prior art of which I am aware is Hollinshead, U.S. Pat. No. 3,849,323, which discloses mixtures of petroleum lubricants, waxes, and polyoxyethylene emulsifiers. Jojoba oil is one of several waxes indicated as useful. This reference does not anticipate nor make obvious the compositions of my invention.

DETAILED DESCRIPTION

The following table sets out the acceptable and the preferred ranges for the individual components comprising the additive concentrate of my invention:

| COMPONENT | USEFUL RANGE (WT. %) | PREFERRED RANGE (WT. %) |
|---|---|---|
| (1) Petroleum base stock | 25–90 | 50–75 |
| (2) Detergent-inhibitor package | 7–40 | 20–30 |
| (3) Supplemental antiwear additive | 1–10 | 1–5 |
| (4) Supplemental antiwear additive | 1–10 | 1–5 |
| (5) Corrosion inhibitor | 0.5–5 | 1–3 |
| (6) Jojoba oil | 0.1–10 | 0.2–8 |

The petroleum base stock may be any oil of lubricating viscosity derived from crude oil by the conventional refining processes, as is well known in the art. Such base stocks are usually designated by their viscosity—for example a suitable base stock for my invention is a 450 Neutral oil from Union Oil Corporation, where the number refers to the viscosity in Saybolt second and "neutral" indicates refining by distillation.

Detergent inhibitor packages are conventionally used in the manufacture of crankcase motor oils and contain the antiwear additives, corrosion inhibitors, detergents and dispersants needed to make a crankcase oil of the desired quality—in this case API Service Rating SF.

Antiwear additives (component 3 above) of the zinc dialkyl dithiophosphate class are used in all modern crankcase motor oils and are familiar to those skilled in the art. Antiwear additives (component 4 above) of the sulfurized olefin class are likewise well known.

Corrosion inhibiting overbased sulfonates are colloidal submicronic dispersions of alkaline and alkaline earth salts, usually carbonates, in an oil solution of an alkaline or alkaline earth alkylbenzene sulfonate salt, derived from an alkylbenzene of natural or synthetic origin having a molecular weight generally in the 250 to 600 range. They are well known in the art.

Jojoba oil is a natural mixture of straight chain unsaturated monocarboxylic acid esters comprising primarily $C_{18}$ to $C_{24}$ monounsaturated alcohols esterified with $C_{18}$ to $C_{24}$ monounsaturated acids. The double bond is located predominantly in the $C_9$ position in both the alcohol and acid portions of the esters. Jojoba oil is conventionally cold-pressed from the seed of *Simmondsia chinensis,* a desert shrub native to California, Arizona, and Mexico. It has the following representative physical properties:

Specific Gravity, 25°/25° C.: 0.863.
Refractive Index (25° C.): 1.4650.
Iodine Value: 82.
Melting Point, °C.: 10.
Kinematic Viscosity (centistokes): 210° F.: 6.48; 100° F. 26.83.

Viscosity Index: 225.
Flash Point, °C.: 295.
Average Molecular Weight: 606.

The following examples 1 and 2 illustrate blends outside of and within the scope of my invention:

| | Example 1 (Wt. %) | Example 2 (Wt. %) | Notes |
|---|---|---|---|
| Petroleum base stock | 67.1 | 66.1 | (1) |
| Detergent-inhibitor package | 25.0 | 25.0 | (2) |
| Supplemantal antiwear additive | 4.1 | 4.1 | (3) |
| Supplemental antiwear additive | 2.5 | 2.5 | (4) |
| Corrosion inhibitor | 1.3 | 1.3 | (5) |
| Jojoba oil | None | 1.0 | |

NOTES:
(1) A 450 Neutral oil from Union Oil Corp.
(2) An API SF additive package containing 1.3% zinc, 1.2% magnesium, 0.8% nitrogen, 1.2% phosphorus, 8.7% sulfated ash.
(3) Zinc dialkyl dithiophosphate containing 8.4% zinc, 7.6% phosphorus, 16% sulfur.
(4) Sulfurized olefin containing 43% sulfur.
(5) Overbase sodium sulfonate, TBN 440.

The composition of example 1 contains all the components of my additive concentrate with the exception of the jojoba oil, and is therefore considered to be outside the scope of my invention. Example 2, containing the identical components plus the jojoba oil, is considered to be a preferred embodiment of my invention.

The compositions of Examples 1 and 2 were compared for their lubricating ability on a friction test machine develped by Wynn Oil Company. In the Wynn friction tester, a steel race consisting of a Timken test cup rotates at 760 rpm against a tapered Timken steel roller bearing held in a container of the lubricant to be evaluated. Approximately 20 mls of lubricant are used. The bearing holder is connected to a lever arm arrangement culminating in a pan to which weights can be added to increase the contact force between the bearing and the race. A thermocouple is used to measure the increase in temperature in the lubricant as the test proceeds. The Wynn friction tester is conventionally run in two different ways. In the first, a constant weight is applied for an extended period, usually an hour, and the temperature increase and the size of the wear scar on the bearing are determined. A smaller wear scar and a lower lubricant temperature at the conclusion of the test indicate a higher level of lubricant protection and reduced friction between moving parts. In the second test procedure, the load on the bearing and race is increased at a regulated rate by the addition of weights to the pan. Failure occurs when the rotation of the race is halted by welding between the bearing and race.

The compositions of Examples 1 and 2 were dissolved at a 10% level in a 150 Neutral petroleum base stock from the Union Oil Corporation. Both solutions were run for one hour on the Wynn friction tester. A load of two one-pound weights was applied to the pan, an oil temperatures and the wear scars on the bearings were measured. The following results were obtained.

| | Example 1, 10% in 150 Neutral (outside scope of my invention) | Example 2, 10% in 150 Neutral (within scope of my invention) |
|---|---|---|
| Temp. °F. | | |
| Initial | 75 | 75 |
| 23 min. | 182 | 179 |
| 30 min. | 185 | 181 |
| 45 min. | 190 | 188 |
| 60 min. | 191 | 190 |

-continued

| | Example 1, 10% in 150 Neutral (outside scope of my invention) | Example 2, 10% in 150 Neutral (within scope of my invention) |
|---|---|---|
| Wear Scar Area (Square inches) | 0.0728 | 0.0657 |

Note that the oil blend containing 10% of Example 2 which included the jojoba oil, and is a preferred embodiment of my invention, ran consistently cooler and left a significantly smaller wear scar on the bearing than the 10% solution of Example 1, which contained no jojoba oil and is outside the scope of my invention. This is especially remarkable in light of the fact that the additive concentrate of Example 2 contains only 1.0% jojoba oil and that the 10% solution actually tested contained only 0.1% jojoba oil. The significant improvement in lubrication achieved by the inclusion of such a minor amount of jojoba oil would certainly not have been obvious to an ordinary skilled worker. The blend may preferably consist essentially of between 5 and 15 weight percent additive concentrate as defined above blended with between 95 and 85 weight percent new fully formulated motor oils; or may consist essentially of between 5 and 15 weight percent additive concentrate as defined above blended with between 95 and 85 weight percent used crankcase motor oil.

The following tests were carried out to establish the usefulness of the additive concentrates of my invention in improving the lubricating properties of a used crankcase motor oil. A sample of a used API SF quality crankcase oil (viscosity grade SAE-10W/40) was evaluated on the Wynn's friction test machine and compared to a sample of the same used oil, to which had been added 10% of the composition of Example 2. In these runs, the number of weights on the pan was increased until welding occurred. Four trials were made on the used oil, and on the used oil containing the compositions of Example 2, and the number of weights that each lubricant would support before failure (welding) was calculated. In addition the average lengths of the scars were determined. The results were as follows:

| | Used Oil Alone | Used Oil Plus 10% by weight of composition of Example 2 |
|---|---|---|
| No. of weights carried | 5 | 9 |
| Scar length (in.) | 0.189 | 0.162 |

The addition of the additive concentrate of my invention to the used oil increased the number of weights it was capable of carrying from 5 to 9, indicating a dramatic increase in lubricant protection. Moreover, the addition of Example 2 composition resulted in reduced wear on the bearing, as evidenced by the shorter wear scar. This test illustrates the ability of the additive concentrate of my invention to substantially or significantly enhance the lubricant protection of a conventional used crankcase oil.

I claim:

1. A crankcase motor oil additive concentrate intended to be added to a conventional crankcase motor oil to improve its ability to lubricate and protect the engine, said additive concentrate comprising the following components:

(a) a petroleum base stock of lubricating quality and viscosity said base stock comprising from about 25 to 90 weight percent of the additive concentrate;
(b) a detergent-inhibitor package, said package being present at from about 7 to about 40 weight percent of the concentrate;
(c) a supplemental antiwear additive selected from the salts of dialkyl dithiophosphoric acids, said additive being present at a level of from about 1 to about 5 weight percent of the concentrate;
(d) a supplemental antiwear additive selected from the class of sulfurized olefins, said additive being present at a level of from about 1 to about 5 weight percent of the concentrate;
(e) a corrosion inhibitor selected from the class of overbased sulfonates, said inhibitor being present at about 1 to about 5 weight percent of the concentrate; and
(f) jojoba oil present in an amount of from about 0.1 to about 10 weight percent of the concentrate.

2. The motor oil additive concentrate of claim 1 wherein the component (b) detergent-inhibitor package is present at a level of 20 to 30 weight percent of the concentrate.

3. The concentrate of claim 2 wherein component (c) consists of zinc salts of dialkyl dithiophosphoric acid which are present at a level of 1 to 5 weight percent of the concentrate.

4. The concentrate of claim 3 wherein component (d) sulfurized olefin is present at a level of 1 to 5 weight percent of the concentrate.

5. The concentrate of claim 4 wherein the component (e) overbased sulfonate is present in the form of a sodium salt and at a level of 1 to 3 weight percent of the concentrate.

6. The concentrate of claim 5 wherein the component (f) jojoba oil is present at a level of 0.2 to 8 weight percent.

7. An oil blend consisting essentially of between 5 and 15 weight percent additive concentrate as defined in claim 1 blend with between 95 and 85 weight percent used or newly formulated crankcase motor oil.

8. A method of improving the ability of a conventional crankcase motor oil to lubricate and protect the engine which includes the step of adding to said motor oil from about 5 to about 15% by weight of the additive concentrate of claim 1.

* * * * *